US005253029A

United States Patent [19]

Kang

[11] Patent Number: 5,253,029

[45] Date of Patent: Oct. 12, 1993

[54] VIDEO COLOR PRINTER WITH PAPER TRAY EJECTION DEVICE AND METHOD THEREFORE

[75] Inventor: Dong H. Kang, Suweon, Rep. of Korea

[73] Assignee: Samsung Electronics Co., Ltd., Rep. of Korea

[21] Appl. No.: 903,956

[22] Filed: Jun. 26, 1992

[30] Foreign Application Priority Data

Jun. 26, 1991 [KR] Rep. of Korea ..... 91-10683

[51] Int. Cl.[5] ..... G03G 21/00

[52] U.S. Cl. ..... 355/321; 271/3.1; 346/134; 355/208; 355/309

[58] Field of Search ..... 355/308, 309, 311, 316, 355/321, 72, 203, 208; 271/3.1; 346/76 PH, 134

[56] References Cited

U.S. PATENT DOCUMENTS 4,279,504 7/1981 Brown et al. ..... 271/3.1 X
4,469,320 9/1984 Wenthe, Jr. ..... 271/3.1 X
4,637,598 1/1987 Bouwens et al. ..... 271/3.1
4,684,235 8/1987 Kohmoto et al. ..... 355/316
4,974,019 11/1990 Nishioka et al. ..... 355/311 X
4,996,556 2/1991 Gray, Jr. ..... 355/311 X
5,021,824 6/1991 Higashi et al. ..... 355/72

*Primary Examiner*—A. T. Grimley
*Assistant Examiner*—William J. Royer
*Attorney, Agent, or Firm*—Sughrue, Mion, Zinn, Macpeak & Seas

[57] ABSTRACT

A video color printer and a control method therefor. If an operating switch is turned on after loading recording paper in a tray of the video color printer, operations such as feeding, printing, discharging of recording papers and ejecting the tray can be carried out automatically. If the recording paper in the tray is exhausted, or if a printing is completed, the tray is automatically ejected so that the printed recording paper can be taken out and new recording paper can be supplied to the tray. Subsequently, the tray is automatically inserted into the main body of the printer.

10 Claims, 3 Drawing Sheets

S1
START
L1
S2
TURN ON MAIN SWITCH
S3
INITIALIZE SYSTEM
S4
RECORDING PAPER LOADED?
N
Y
L4
EJECT TRAY
S11
DEACTIVATE MOTOR
S12
LOAD NEW RECORDING PAPER
S13
INSERT TRAY
S14
DEACTIVATE MOTOR
S15
PRESETTING NUMBER OF SHEETS
S5
S6
TURN ON PRINT COMMAND SWITCH
L2
S7
PRESET NUMBER OF PRINTING FINISHED?
N
Y
EJECT TRAY
S8
S9
DEACTIVATE MOTOR
L3
INSERT TRAY
S10

VIDEO COLOR PRINTER WITH PAPER TRAY EJECTION DEVICE AND METHOD THEREFORE

FIELD OF THE INVENTION

The present invention relates to a video color printer, in which if a number of sheets of recording paper to be printed are provided and the relevant key is pressed, printing operations are automatically carried out.

BACKGROUND OF THE INVENTION

Generally, as shown in FIG. 1, a video color printer has a printing part which includes a thermal recording head 1 with a heat radiating medium formed on the bottom thereof, a ribbon cassette 2 with ink ribbons 2*a* for Y (Yellow), M (Magenta) and C (Cyan) wound thereon, a drum 3 for guiding and printing a thermal recording paper, a tray 4 for holding sheets of recording paper, a paper feed roller 5 for feeding sheets of recording paper from the tray 4 to the printing part, and a paper discharge roller 6 for discharging the sheets of recording paper to an ejecting part 7 when the recording papers are printed.

In the video color printer as described above, the paper feed roller 5 is rotated by a driving motor for feeding the sheets of recording paper from the tray 4 to the printing part.

If video signals of a color picture and the like are transferred to the thermal recording head 1, the three colors of the ink ribbons 2*a* are successively printed on the recording paper by the heat radiating medium installed on the bottom thereof so that a desired picture can be printed on a sheet of recording paper wound on the drum 3.

When printing is finished, the recording paper is transmitted through the discharge roller 6 to the ejecting part 7 and the ejecting part 7 advances forward by the driving motor so as to allow removal of the printed paper manually, thereby completing the printing operation.

In the conventional video color printer as described above, if the recording papers stacked on the tray 4 are exhausted, the tray 4 must be completely removed to supply new sheets of recording paper and re-installed on the body of the printer after supplying the paper manually. Furthermore, existence or absence of the recording paper has to be checked manually. Accordingly, loading paper in such a device is inefficient and inconvenient.

SUMMARY OF THE INVENTION

The present invention is intended to overcome the above-described disadvantages of the conventional techniques.

Therefore, it is an object of the present invention to provide a video color printer and a control method thereof, in which if an operating key is pressed for printing a desired number of sheets of recording paper after loading the tray with the recording paper, all the operations for printing on the recording paper are carried out automatically.

According to one aspect of the present invention, there is provided a video color printer having a tray for loading sheets of recording paper. A paper feeding device for supplying the recording paper from the tray to a drum, a printing device for printing a picture on the recording paper, a paper discharge device for ejecting the printed paper after completion of the printing by the printing device, a recording paper loading state sensor disposed on the tray for sensing a presence or absence of the recording paper, a printing completion sensor disposed on the tray for sensing complete printing of the recording paper, and a tray driving device for moving the tray so as to be automatically ejected if no recording paper is sensed in the tray.

According to another aspect of the present invention, there is provided a control method for a video control printer. The method has the steps of a discriminating routine for initializing the system by turning on a main switch and for discriminating existence or absence of recording paper in a tray, an executing routine for presetting a number of sheets of recording paper to print. If the recording paper is present in the tray, a tray moving routine is executed for ejecting the tray to take out printed recording paper when the preset number of sheets are printed, relocating the tray in the video color printer. A recording paper loading routine ejects the tray outwardly to load recording paper if the recording paper is absent from the tray.

BRIEF DESCRIPTION OF THE DRAWINGS

The above object and other advantages of the present invention will become more apparent by describing in detail the preferred embodiment of the present invention with reference to the attached drawings, in which.

DETAILED DESCRIPTION OF THE PREFERRED EMBODIMENT

Figure 1:
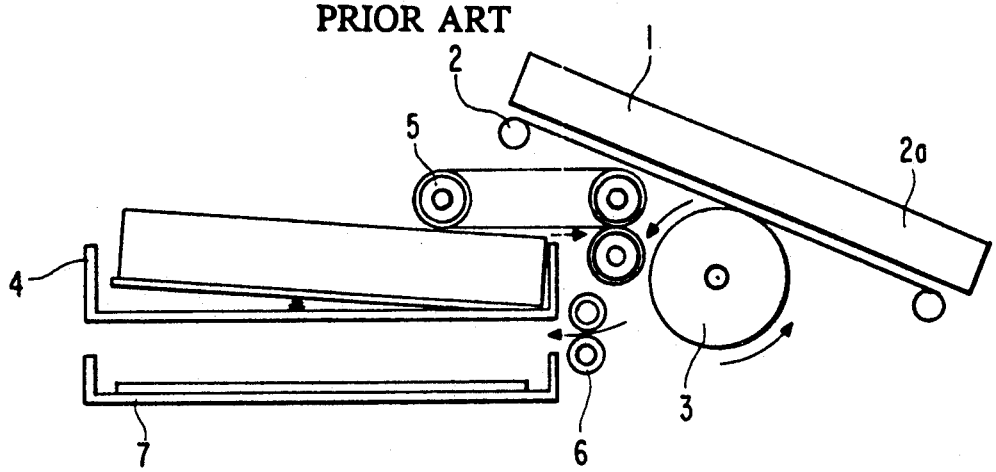
FIG. 1 PRIOR ART
FIG. 1 is a schematic view of a conventional video color printer.
Figure 2:
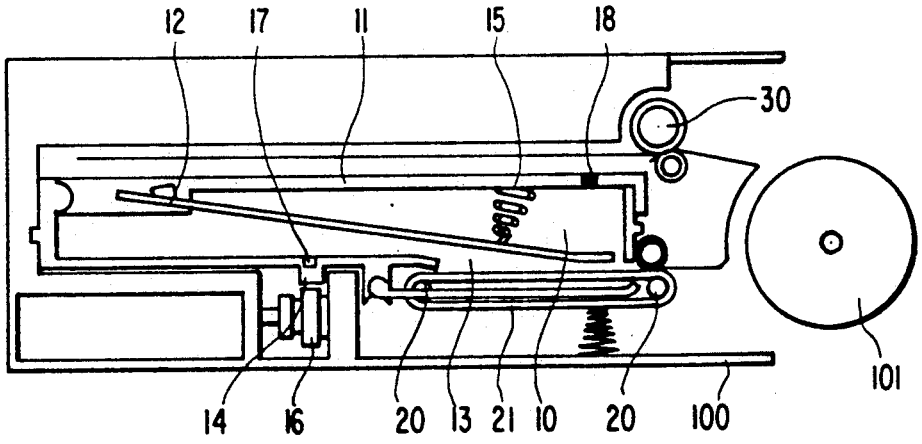
FIG. 2 is a cross-sectional view showing a video color printer according to a preferred embodiment of the present invention.

FIG. 2 is a cross-sectional view showing a video color printer according to the present invention. In FIG. 2, a main body 100 of the video color printer contains a tray 10 for loading sheets of recording paper, a tray driving device for moving the tray 10, and a printing part for printing the recording papers transmitted from the tray 10.

The tray 10 has a lid 11 which is hinge-coupled with the tray 10, and a pressing portion 12 resiliently installed on a bottom of the lid 11 by means of an elastic member 15 for pressing down the loaded recording paper in the tray 10.

A recording paper feeding opening 13 is formed on one side of the bottom of the tray 10, and paper feed rollers 20 are installed below the feeding opening 13, with a belt 21 surrounded thereon. Driven roller 21 is disposed in opposition to one of the feed rollers 20 so as to be in rotatable contact therewith. Sheets of recording paper in the tray 10 are sequentially supplied, between feed rollers 20 and driven rollers 21, toward a drum 101 downwardly by friction between the belt 21 and the paper which is pressed by the pressing portion 12. Under the tray 10, a tray driving device for ejecting the tray 10 is installed. The tray driving device has a rack gear 14 formed on the bottom of the tray 10 longitudinally, and a driving gear 16 in rotating engagement with the rack gear 14 and driven by a motor (not shown) which is installed at one side in the main body 100.

Further, a discharge roller 30 is installed at one side of the lid 11 of the tray 10 for transmitting printed sheets of recording paper onto the lid 11 after the completion of a printing operation by the printing part. Driven roller 31 is disposed in opposition to discharge roller 30 in rotatable contact therewith. Guide member 33 directs paper onto drum 101, from feed rollers 20 and driven rollers 21, and off of drum 101 to discharge roller 30 and driven roller 31. Guide member 33 is offset, with respect to paper feed rollers 20 and discharge roller 30, in the direction into the page in FIG. 2 so as not to interfere with paper feeding.

A printing completion sensor 18 is installed on the lid 11 of the tray 10 for detecting if there is recording paper stacked on the lid 11. The printing completion sensor 18 may preferably have light emitting means and light receiving means and assumes an on or off state based upon whether or not recording paper is stacked on the lid 11.

In the bottom of the tray 10, paper loading state sensor 17 is installed for sensing the existence or absence of recording paper in the tray 10. If recording paper is not in the tray 10, the motor is driven to eject the tray 10.

Figure 4:
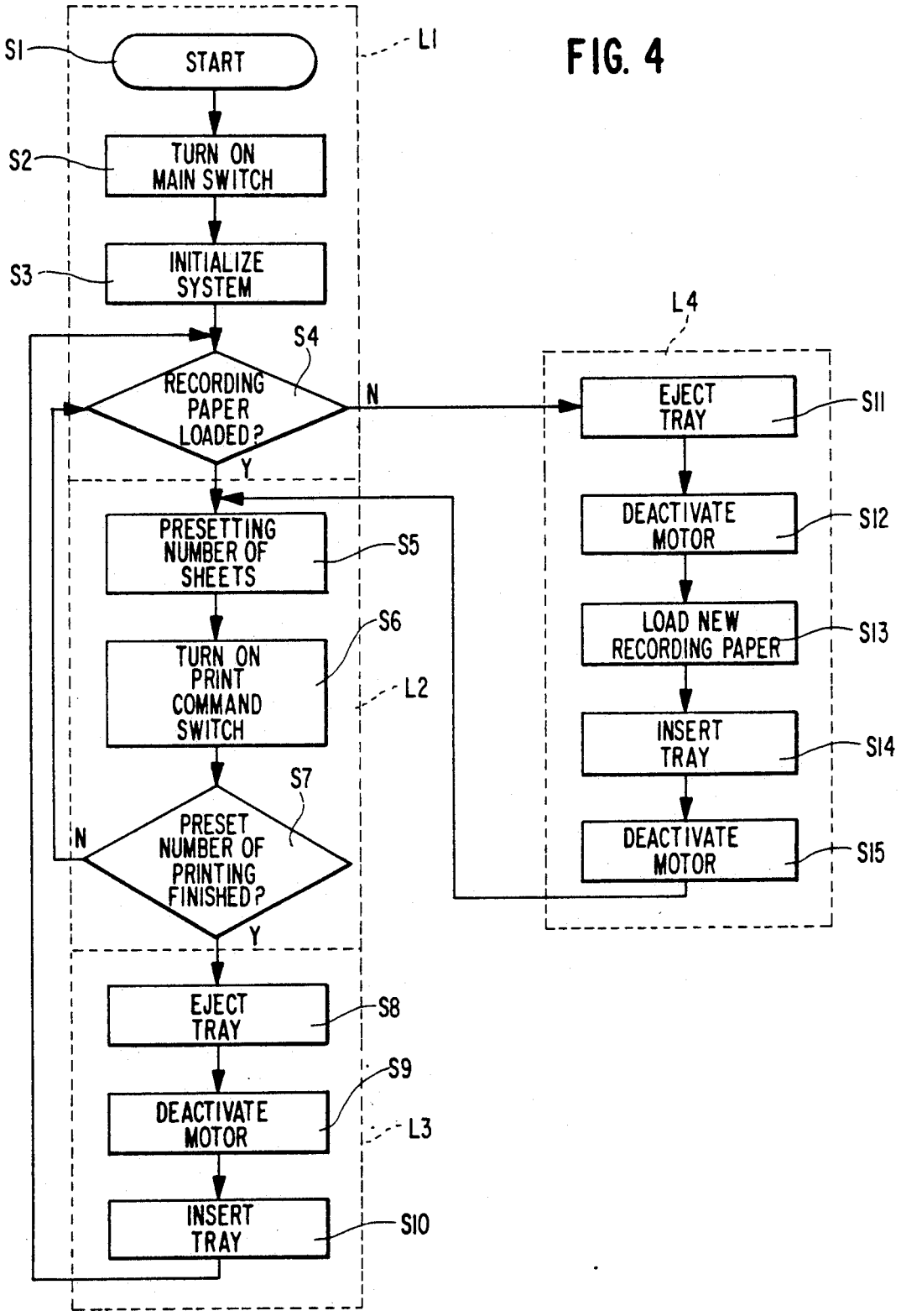
FIG. 4 is a flow chart for explaining a control method for the video color printer according to the present invention.

FIG. 4 is a flow chart showing the control method of the video color printer of the present invention.

As shown in FIG. 4, the control method comprises a discriminating routine L1 for turning on a main switch to initialize the system and to carry out discrimination of whether or not the recording paper is in the tray 10, an executing routine L2 for presetting a desired number of sheets of recording paper to print as necessary if the existence of recording paper is detected in the tray 10, a moving routine L3 for moving the tray 10 so as to allow removal of the recording paper from the lid 11 as soon as the preset number of sheets of recording paper has been printed upon, and a loading routine L4 for moving the tray 10 to load recording paper if the absence of the recording papers is detected in the tray 10. The entire device can be controlled by a microprocessor based controller, a hardwired relay panel or any other suitable control device (not shown). The number of sheets printed can be counted by any known means, such as a photosensor, or the like.

The discriminating routine L1 comprises steps S2 and S3 for initializing the system by turning on and off the main switch, and a discriminating step S4 for discriminating as to the existence of the recording paper in the tray 10.

The executing routine L2 comprises steps S5 and S6 for presetting a desired number of sheets of recording paper to print and for turning on a print command switch, and step S7 for printing on the recording paper in response to turning on the print command switch. The desired number of sheets to be printed is input, by an operator, through a keypad or any other data input device.

The moving routine L3 is carried out for moving the tray 10 to allow removal of the printed sheets of recording paper. If the preset number of sheets has been printed upon, the motor is reversely rotated so as to eject the tray 10 outwardly (step S8). When the tray 10 is substantially exposed, the motor is deactivated (step S9). Subsequently, the tray 10 is inserted into the main body 100 again after a certain period of time has elapsed which is sufficient for the printed sheets of recording paper to be removed by an operator (step S10).

The recording paper loading routine L4 is carried out for moving the tray 10 outwardly to load recording paper when recording paper is exhausted from the tray 10. The recording paper loading routine L4 comprises a step S11 for ejecting the tray 10 outwardly by reversely rotating the motor in response to an off state of the recording paper loading state sensor 17, a step S12 for deactivating the motor if the tray is substantially exposed, a step S13 for loading recording paper in the tray 10 (which may be done manually), a step S14 for inserting the tray 10 into the main body 100 by forwardly rotating the motor after a certain period of time (e.g., several seconds) has elapsed after the recording paper loading state sensor 17 has assumed an on state, and a step S15 for deactivating the motor as soon as the tray 10 is inserted into the main body 100.

Figure 3:
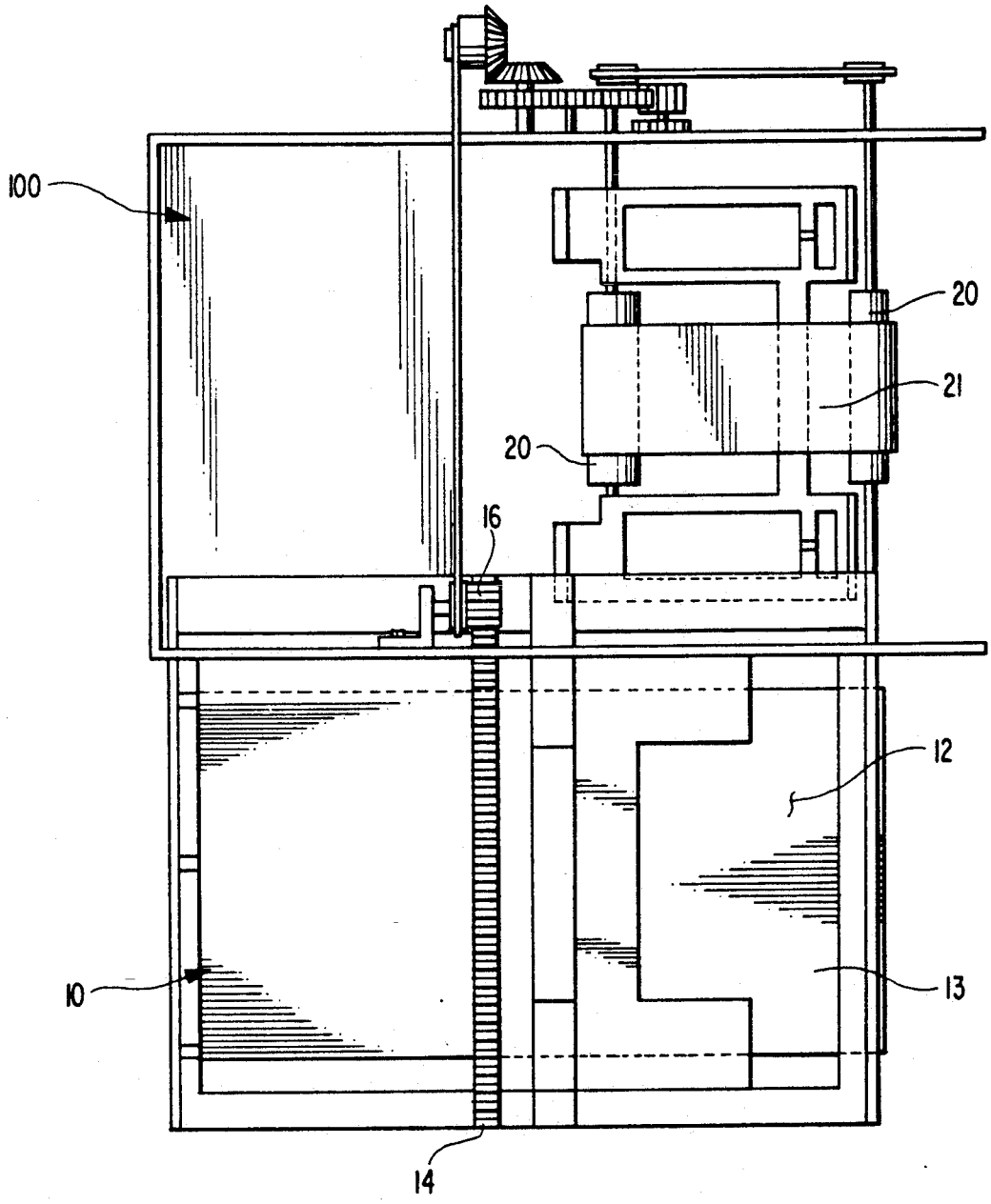
FIG. 3 is a schematic bottom view showing a state in which a tray of the video color printer according to the preferred embodiment of the present invention is substantially ejected outwardly.

Now the operation of the video color printer of the present invention will be described in further detail, referring to FIGS. 2 to 4.

In order to operate the video color printer of the present invention, the main switch of the video color printer is turned on (S2) and the system of the video color printer is initialized (S3). Then the recording paper loading state is sensed by the recording paper loading state sensor 17 (S4). In other words, if the recording paper loading state sensor 17 is in an on state, paper is present in the tray 10. If it is off, there is no paper in the tray 10. Further operations are carried out in response to the existence or absence of recording paper in the tray 10.

First, in the absence of the recording paper, the recording paper loading state sensor 17 installed on the bottom of the tray 10 is turned off, and the tray 10 is ejected outwardly by reversely rotating the motor (S11). The tray 10 moves by virtue of a driving gear 16 rotated by a motor which rotates forward or reversely according to the sensing state of the sensor 17 and other parameters. The driving gear 16 is engaged with a rack gear 14 formed on the bottom of the tray 10, and therefore, the tray 10 is ejected outwardly corresponding to the reverse rotation of the motor.

When the tray 10 is substantially exposed, the motor is deactivated (S12) and, the lid 11 of the tray 10 is opened to stack new recording paper therein (S13). Thus, if the new recording paper is loaded in the tray 10, the recording paper loading state sensor 17 is turned on for driving the motor to rotate forward after a delay of several seconds so that the tray 10 can be inserted into the main body 100 (S14). The delay is preset in the control device so as to allow the operator adequate time to complete the loading of paper before the tray is inserted.

The ejecting and inserting of the tray 10 is carried out by the rack gear 14 and the driving gear 16 being engaged with each other for rotating in response to the driving direction of the motor as described above. Thus, when the tray 10 is relocated in the main body 100 after loading the recording paper, the motor is deactivated (S15) and printing can be carried out as desired by the user as illustrated in FIG. 4 (executing routine L2). Meanwhile, in the case where recording paper is in the tray 10 at the discriminating step L1, the recording paper loading routine L4 is skipped, and the executing routine L2 is directly carried out in order to perform the desired printing operation.

The operation of the executing routine L2 is started from step S5 for presetting a number of sheets of recording paper to print and then, a print command switch is turned on (S6). If the print command switch is turned on (S6), the paper feed rollers 20 installed under the tray 10 are rotated, along with the belt 21, by the motor. The number of sheets to be printed is preset by the operator through a keypad, or the like, coupled to the control device.

Accordingly, the recording paper loaded in the tray 10 is supplied, one sheet at a time, through the recording paper feeding opening 13 by the belt 21. Then the sheets of recording paper are printed upon by the printing part and each of the printed sheets of recording paper is discharged onto the top of the lid 11 of the tray 10 by the discharge roller 30 disposed above the tray 10.

Under this condition, the number of sheets of recording paper which have been printed (S7) is compared with the preset number. When the preset number of sheets of recording paper are stacked on the lid 11 of the tray 10, the motor is driven to rotate reversely so as to eject the tray 10 outwardly (S8). Then, the user can remove the printed sheets of recording paper conveyed to the outside, which are laid on the lid 11 of the tray 10. The printing completion sensor 18 is turned off as soon as the user removes the conveyed papers.

After a certain period of time (e.g., several seconds) has elapsed, the motor rotates in a forward direction for inserting the tray 10 into the main body 100 to be ready for further printing (S10). If the printed sheets of recording paper on the lid 11 of the tray 10 are not removed after a predetermined period of time, the tray 10 is still relocated into the main body 100. In such a situation, the printer will await a new print command, and a new preset number will be set before printing resumes.

Meanwhile, as shown in FIG. 4, in spite of the fact that a print command is received by the print command switch, if the printing is not carried out until the number of printed sheets is equal to the preset number, it means that the number of recording paper sheets originally loaded in the tray 10 is less than the preset amount. Therefore, if the recording paper in the tray 10 is depleted before completing printing of the preset number of sheets, the recording paper loading routine L4 is carried out for allowing the loading of additional recording paper in the tray 10 and then the executing routine L2 and the moving routine L3 are carried out automatically for printing continuously.

According to the present invention as described above, if the operating switch is preset to a desired condition after loading the recording papers in the tray 10, all the printing operations are carried out automatically.

Further, the ejecting means used in the conventional printer is eliminated, and all operations such as the paper supply, the paper discharge, and the paper ejection are all carried out through the tray without the need for completely detaching the tray from the video color printer, so that the loading of paper is more convenient.

The invention is not limited to the embodiment described hereinabove. Various modifications of disclosed embodiment, as well as other embodiments of the invention, will become apparent to persons skilled in the art upon reference to the description of the invention. It is therefore contemplated that the appended claims will cover any such modifications or embodiments that are within the true scope of the invention.

What is claimed is:

1. A video color printer having a tray for accommodating recording paper, a paper feeding device for supplying said recording paper from said tray to a drum, a printing device for printing an image on said recording, and a paper discharge device for ejecting said paper after completion of the printing by said printing device, said printer comprising:

a recording paper loading state sensor disposed in said tray so as to sense the presence or absence of said recording paper in said tray;

a printing completion sensor disposed on said tray so as to sense complete printing of said recording paper; and a tray driving device coupled to said tray, said loading state sensor and said printing completion sensor so as to move said tray to be automatically ejected if an absence of said recording paper is sensed in said tray or a predetermined number of sheets of said recording paper have been printed upon.

2. The video color printer as claimed in claim 1, wherein said tray comprises:

an ejecting opening formed on a lower portion of said tray for downwardly feeding said recording paper therefrom;

a lid coupled with said tray; and a pressing device installed on said lid by virtue of an elastic member so as to press said recording papers toward said ejecting opening.

3. The video color printer as claimed in claim 1, wherein said recording paper loading state sensor is disposed on an inner portion of a bottom surface of said tray so as to sense the presence or absence of said recording paper and to cause said tray driving device to eject said tray when the absence of said recording paper in said tray is sensed thereby.

4. The video color printer as claimed in claim 1, wherein said printing completion sensor includes light emitting means and light receiving means installed on a lid of said tray for sensing printed sheets of said recording paper on said lid to eject said tray by activating said tray driving device.

5. The video color printer as claimed in any one of claims 1 to 4, wherein said tray driving device includes:

a rack gear formed on a bottom portion of said tray so as to extend in a longitudinal direction;

a motor for ejecting said tray in response to signals from said recording paper loading state sensor and said printing completion sensor; and a driving gear coupled to said motor and being disposed at one side of a main body of said video color printer and engaged with said rack gear, said driving gear rotating when said motor is driven in response to said signals.

6. A control method for a video color printer, comprising:

a discriminating step which initializes the video color printer by turning on a main switch so as to discriminate between presence or absence of recording paper in a tray;

an executing step which presets a number of sheets of recording paper to print when the presence of said recording paper is detected in said tray;

a tray moving step which ejects said tray out of a main body of said video color printer to take out printed sheets of recording paper when a number of said sheets of said recording paper that have been printed is equal to the number preset during said executing step and to relocate said tray in said video color printer; and a recording paper loading step which ejects said tray outwardly to load recording paper therein if said recording paper is absent from said tray during said disciminating step.

7. The control method for a video color printer as claimed in claim 6, wherein said discriminating step comprises the steps of:

initializing the video color printer by turning a main power switch on or off; and discriminating a loading state of said recording paper in said tray.

8. The control method for a video color printer as claimed in claim 6, wherein said executing step comprises the steps of:

presetting a number of sheets of recording paper to print;

turning on a print command switch; and printing on said recording paper.

9. The control method for a video color printer as claimed in claim 6, wherein said moving step comprises the steps of:

ejecting said tray outwardly by rotating a motor reversely to expose said tray if a number of sheets of said recording paper which have been printed is equal to a number preset during said executing step;

deactivating said motor when said tray is substantially exposed; and inserting said exposed tray into said main body of said video color printer after a first predetermined amount of time has elapsed.

10. The control method for a video color printer as claimed in claim 6, wherein said recording paper loading step comprises the steps of:

ejecting said tray outwardly by rotating a motor reversely in response to an off state of a recording paper loading state sensor disposed in said tray;

deactivating said motor when said tray is substantially exposed;

loading recording paper in said tray;

inserting said tray into said main body by driving said motor forward after a second predetermined amount of time has elapsed after said loading step; and deactivating said motor when said tray is completely inserted into said main body.

* * * * *